US006291711B2

(12) United States Patent
Langlet

(10) Patent No.: US 6,291,711 B2
(45) **Date of Patent: *Sep. 18, 2001**

(54) GUANYLUREA DINITRAMIDE, AN EXPLOSIVE, PROPELLANT, ROCKET MOTOR CHARGE AND GAS GENERATOR

(75) Inventor: Abraham Langlet, Stockholm (SE)

(73) Assignee: Totalforsvarets Forskningsinstitut (FOI), Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/423,636

(22) PCT Filed: May 20, 1998

(86) PCT No.: PCT/SE98/00949

§ 371 Date: Nov. 17, 1999

§ 102(e) Date: Nov. 17, 1999

(87) PCT Pub. No.: WO98/55428

PCT Pub. Date: Dec. 10, 1998

(30) Foreign Application Priority Data

May 21, 1997 (SE) ..... 9701897

(51) Int. Cl.[7] ..... C07C 273/00
(52) U.S. Cl. ..... 564/59; 564/58
(58) Field of Search ..... 149/45; 252/350, 252/357; 564/32, 58, 59

(56) References Cited

U.S. PATENT DOCUMENTS

| | | | | |
|---|---|---|---|---|
| 2,953,448 | | 9/1960 | Maxwell | 52/7 |
| 3,758,555 | | 9/1973 | Koshar et al. | 260/482 R |
| 5,659,080 | * | 8/1997 | Suzuki et al. | 564/109 |
| 6,004,410 | * | 12/1999 | Blomquist | 149/45 |

FOREIGN PATENT DOCUMENTS

| | | |
|---|---|---|
| 0 519 485 | 12/1992 | (EP) . |
| 0 607 446 | 7/1994 | (EP) . |
| 91/19669 | 12/1991 | (WO) . |
| 91/19670 | 12/1991 | (WO) . |
| 93/16002 | 8/1993 | (WO) . |
| 96/26169 | 8/1996 | (WO) . |
| 97/06099 | 2/1997 | (WO) . |

OTHER PUBLICATIONS

CA:125:225967 abs of DE 19505568, Aug. 1996.*

CA::118:84038 abs of EP 519485, Dec. 1992.*

* cited by examiner

*Primary Examiner*—Jean F. Vollano
(74) *Attorney, Agent, or Firm*—Jacobson Holman, PLLC

(57) ABSTRACT

A new chemical compound suitable for use as an explosive consists of guanylurea dinitramide having the formula which is also suitable as a main essential component for explosives, especially propellants; a pressed rocket motor charge; and a gas-generating component in gas generators for vehicle safety equipment, such as airbags.

9 Claims, 1 Drawing Sheet

GUANYLUREA DINITRAMIDE, AN EXPLOSIVE, PROPELLANT, ROCKET MOTOR CHARGE AND GAS GENERATOR

This application is a 371 of PCT/SE98/00949, filed May 20, 1998, now WO 98/55423.

The invention relates to a new compound suitable for use as an explosive. More specifically, the invention concerns a new dinitramide salt. The salt can be used as a high explosive, propellant or gas-generating compound in gas generators in pure form or as a component in explosive compositions.

The preparation of dinitramide salts such as ADN (ammonium dinitramide) and KDN (potassium dinitramide) is disclosed in, for instance, WO 91/19669, WO 91/19670, WO 93/16002 and WO 97/06099. These dinitramide salts are, in the first place, intended to be used as oxidizers, e.g. to replace ammonium perchlorate, in explosive compositions. The absence of chlorine is advantageous from the viewpoint of air pollution and in military applications owing to a decreased exhaust gas signature.

An object of the present invention is to provide a compound which is suitable as an explosive, which contains the dinitramide ion, which has low solubility in water and low impact and friction sensitivity.

A further object of the invention is to provide a homogeneous propellant which contains the dinitramide ion and which has good pressing properties.

One more object of the invention is to provide a compound which is suitable as a gas-generating compound in gas generators for vehicle safety equipment, such as airbags.

The invention is defined in the claims.

According to the invention the compound consists of guanylurea dinitramide having the formula

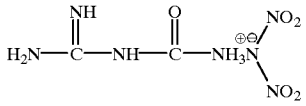

and referred to as GUDN.

The invention also concerns an explosive containing the compound; a propellant containing the compound; a pressed rocket motor charge containing the compound as the main component, and use of the compound as a gas-generating compound in gas generators for vehicles safety equipment, such as airbags.

GUDN is a white crystalline powder which has low solubility in water, has no melting point and has a decomposition temperature of about 180° C. The crystal size may vary according to the conditions of preparation. The powder is pressable and can be pressed to, for instance, propellant grains and rocket motor charges of different shape. The burning properties are favorable. The burning rate is high and linearly dependent on pressure, the formed combustion gases are light. GUDN is highly insensitive to impact and friction. When testing the impact sensitivity in a BAM fall hammer with a fall weight of 2 kg, the compound was not initiated even when the fall height was increased to 2 m. For comparison, it may be mentioned that RDX at a corresponding fall weight is initiated at a fall height of 38 cm. The friction sensitivity could not be tested in a normal Julius Peter friction tester since the compound was not initiated within the capacity range of the tester (36 kp pistil load).

Figure 1:
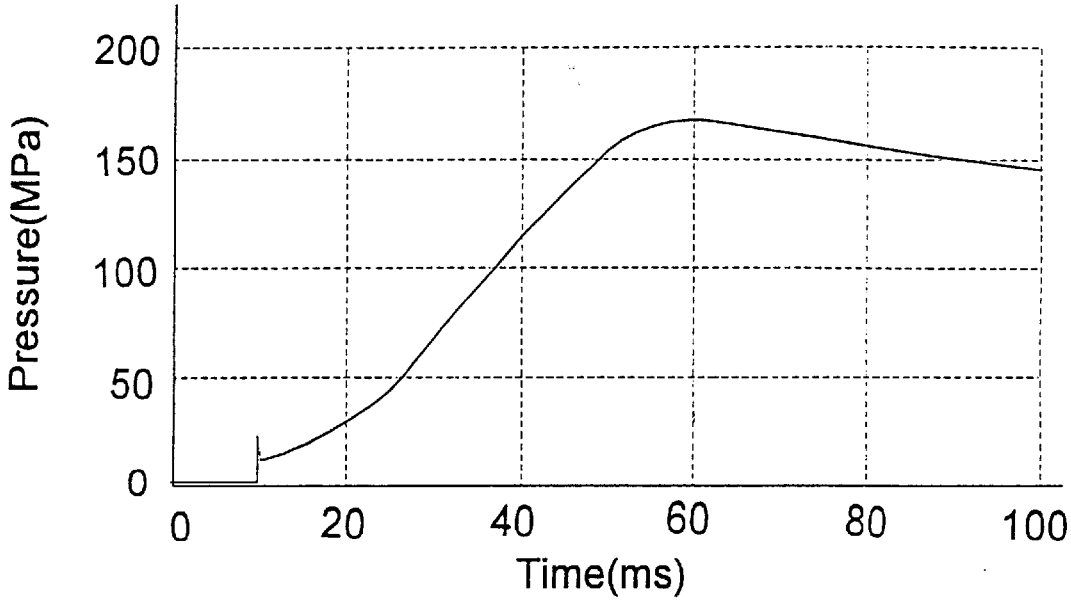
FIG. 1. Shows a pressure time curve of GUDN.

GUDN can be made to detonate and then has a detonation velocity that can be compared to RDX. The compound can thus be used as a high explosive in pure form or as a component in explosive compositions. In many applications where explosives are used, binder systems and preparation methods have been developed for explosives which are not water-soluble, such as HMX and RDX. GUDN can be used in such binder systems and preparation methods and replace previously used explosives.

GUDN can be used as a propellant alone or as a component in propellant compositions and can, in many applications, replace e.g., nitramine propellant, composite propellant and nitrocellulose propellant. The stability is better than for NC propellant and composite propellant, and the burning rate is higher than for nitramine propellant. GUDN produces considerably lighter combustion gases than e.g., an NC propellant, which is advantageous in projectile propellant charges when higher muzzle velocities are desired. This is the case, for instance, with shotgun ammunition when steel pellets are used instead of the considerably heavier lead pellets. Propellants based on GUDN can thus have great advantages in a number of applications in which NC propellants are currently predominant.

GUDN has suitable properties for use as a rocket propellant and, owing to the excellent pressing properties, pressed rocket motor charges can be prepared, containing GUDN as the main component. A small amount of binder, e.g. a polymer, can be used to increase the pressability and the strength of the compact, but for many applications, sufficient strength can be achieved without the addition of a binder.

Especially for rockets, such as emergency rockets and the like, which at regular intervals are exchanged and scrapped, a pressed motor charge of GUDN gives great advantages. In emergency rockets, use is in most cases made of propellant charges consisting of ammonium perchlorate and a polymeric binder, for instance, a phenol resin, which is cured to a cross-linked structure. The reliability of an emergency rocket decreases in course of time and the rocket must therefore be replaced at regular intervals. The motor absorbs, among other things, moisture since ammonium perchlorate is hygroscopic. Upon replacement, the old rocket is returned to the manufacturer and the rocket motor charge is destroyed (burnt).

GUDN is non-hygroscopic and offers even in this respect an advantage relative to propellant charges containing ammonium perchlorate. GUDN has very low solubility in cold water and moderate solubility in hot water. A pressed charge consisting of GUDN as the main component can therefore be scrapped by being dissolved with hot water as solvent, and pure GUDN can be recrystallised from the aqueous solution and be reused. An environmentally acceptable scrapping of the rocket motor charge and reuse of the propellant can thus be achieved.

Moreover, the compound is fully soluble in ADN and can be used as an additive to ADN in, for instance, rocket propellants for decreasing the burning exponent.

Another very advantageous field of application for GUDN is the use as a gas-generating compound in gas generators for vehicle safety equipment such as airbags and the like. In the same manner as for emergency rockets, the possibility of environmentally acceptable recovery of the gas-generating compound is essential to these gas generators. In gas generators for airbags and the like, use is today made of compositions containing azides, composite propellant, NC propellant and nitramine propellant, which all have advantages and disadvantages. Azides are noxious; composite propellant contains chlorine, which generates noxious combustion gases, inter alia, dioxins and HCl; NC propellant causes problems with the longterm stability; nitramine propellant does not generate noxious gases but has a low burning rate and the combustion is difficult to catalyse.

GUDN has all advantages and generates no noxious gases, has good stability and a burning rate which is comparable to NC propellant.

The low solubility of the compound in water makes it easy to prepare by a precipitation reaction from an aqueous solution. An aqueous solution of a guanylurea salt, e.g. guanylurea salfate, is reacted with a water-soluble dinitramide salt, thereby forming a precipitate of guanylurea dinitramide.

Suitable guanylurea salts that can be used in the preparation are those that can be dissolved in water. A certain acidification of the water may be required to make the salt dissolve.

Suitable dinitramide salts that can be used in the preparation are, for instance, ADN, KDN and other water-soluble dinitramide salts, which are selected in consideration of the condition that the positive ion should not form an additional precipitate which makes the extraction of the guanylurea dinitramide difficult.

The invention will be described below by way of Examples.

EXAMPLE 1

Solution 1

3.2 g of guanylurea salfate were dissolved in 15 ml of water after adjusting the pH to 5–7 by dripping diluted sulfuric acid into the water. A clear solution was obtained.

Solution 2

2.5 g of ADN were dissolved in 3 ml of water.

Solution 1 was added to solution 2, thereby forming a precipitate. The precipitate was filtered off and washed with water. 3.4 g of guanylurea dinitramide were obtained as a fine white powder.

Figure 2:
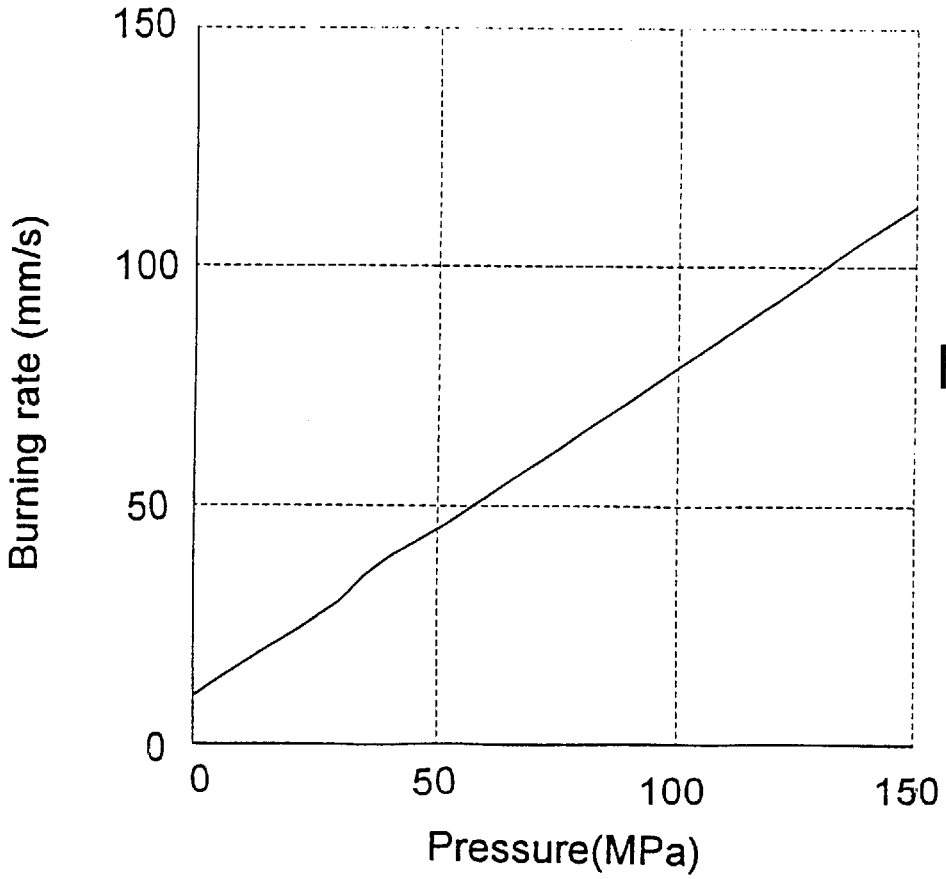
FIG. 2. Shows the burning rate as a function of pressure.

The powder was pressed to pellets and the burning properties were tested in a burning chamber (minibomb). A measured pressure/time curve from the combustion is shown in FIG. 1, and FIG. 2 shows the burning rate as a function of pressure. The burning rate was linearly dependent on the pressure and generally comparable to an NC propellant.

EXAMPLE 2

Solution 1

3.2 g of guanylurea sulfate were dissolved in 30 ml of water in the same way as in Eample 1.

Solution 2

2.5 g of ADN were dissolved in 30 ml of water.

Both solutions were heated to 40° C. and mixed. The product crystallized slowly when cooling the mixture. The crystals were filtered off and washed with water. 3.2 g of guanylurea dinitramide were obtained in the form of white crystals. In this case the crystals were considerably larger than in the product of Example 1.

In a manner corresponding to that described in Examples 1 and 2, the product can be prepared by using KDN or some other water-soluble dinitramide salt. It is also possible to prepare guanylurea dinitramide in direct connection with the preparation of the dinitramide salt. For instance WO 97/06099 discloses how dinitramide salt is prepared by neutralization of dinitramide acid prepared by nitration. A guanylurea salt can be added directly to this mixture without first isolating the dinitramide salt. A certain coprecipitation of nitrates, however, may arise.

EXAMPLE 3

A fine powder of GUDN was pressed to a charge with the dimensions 30 mm diameter and 2 mm height. The charge was extracted with boiling water in a Soxhiet extraction apparatus. The charge was completely dissolved and GUDN recrystallized in the flask. A new charge could be pressed from the recrystallized substance.

What is claimed is:

1. A compound guanylurea dinitramide having the formula.

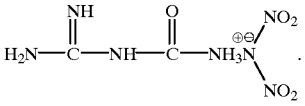

2. An explosive composition comprising, as an essential active component, the compound of claim 1.

3. A propellant composition comprising, as an essential active component, the compound of claim 1.

4. A pressed rocket motor charge composition comprising, as an essential active component, the compound of claim 1.

5. A gas generating composition comprising, as an essential active component, the compound of claim 1.

6. A pressable rocket propellant composition comprising, as an essential active component, the compound of claim 1.

7. An explosive composition consisting essentially of the compound of claim 1.

8. A high explosive composition consisting essentially of the compound of claim 1.

9. A pressed-into-shape hot-water-soluble solid rocket motor charge comprising, as a main component, the compound of claim 1.

* * * * *